US009399932B2

(12) United States Patent
Kwak et al.

(10) Patent No.: US 9,399,932 B2
(45) Date of Patent: Jul. 26, 2016

(54) VARIABLE VALVE DEVICE THAT VARIES LIFT AMOUNT OF VALVE

(71) Applicant: Hyundai Motor Company, Seoul (KR)

(72) Inventors: Young Hong Kwak, Gyeonngi-Do (KR); Gyu Han Hwang, Gyeonggi-Do (KR); Jin Kook Kong, Gyeonggi-Do (KR); Gee Wook Shin, Gyeonggi-Do (KR); Won Gyu Kim, Seoul (KR); Myungsik Choi, Seoul (KR)

(73) Assignee: Hyundai Motor Company, Seoul (KR)

( * ) Notice: Subject to any disclaimer, the term of this patent is extended or adjusted under 35 U.S.C. 154(b) by 48 days.

(21) Appl. No.: 14/523,546

(22) Filed: Oct. 24, 2014

(65) Prior Publication Data

US 2015/0114330 A1 Apr. 30, 2015

(30) Foreign Application Priority Data

Oct. 28, 2013 (KR) ..... 10-2013-0128674

(51) Int. Cl.
*F01L 1/34* (2006.01)
*F01L 1/24* (2006.01)
*F01L 1/047* (2006.01)

(52) U.S. Cl.
CPC ..... *F01L 1/2411* (2013.01); *F01L 1/047* (2013.01); *F01L 1/34* (2013.01)

(58) Field of Classification Search
CPC ..... F01L 1/2411; F01L 1/34; F01L 1/047
USPC ..... 123/90.16
See application file for complete search history.

(56) References Cited

U.S. PATENT DOCUMENTS 5,269,270 A * 12/1993 Suzuki ..... F01L 1/267 123/193.5
5,353,756 A * 10/1994 Murata ..... F01L 1/267 123/90.16
7,207,300 B2 4/2007 Ezaki et al.

FOREIGN PATENT DOCUMENTS

JP 3984321 B2 10/2007
JP 4292147 B2 7/2009
JP 2009-209847 A 9/2009

* cited by examiner

*Primary Examiner* — Zelalem Eshete
(74) *Attorney, Agent, or Firm* — Mintz Levin Cohn Ferris Glovsky and Popeo, P.C.; Peter F. Corless

(57) ABSTRACT

A variable valve device for varying a lift amount of a valve includes a first valve and a second valve that are respectively disposed to open or close a port, a swing arm in which first and second valve pressing portions are formed at both sides to press the first valve and the second valve, one supporting portion that supports a part that is apart from the first and the second valve pressing portions on the swing arm, a lost body that is rotatably disposed on the swing arm through a lost pin, a camshaft on which a first cam and a second cam are formed to respectively press the lost body and the swing arm, and a latching pin that selectively fixes the swing arm with the lost body and is disposed to move in a direction that the first and the second valves are arranged.

10 Claims, 5 Drawing Sheets

VARIABLE VALVE DEVICE THAT VARIES LIFT AMOUNT OF VALVE

CROSS-REFERENCE TO RELATED APPLICATION

This application claims under 35 U.S.C. §119(a) priority to and the benefit of Korean Patent Application No. 10-2013-0128674 filed in the Korean Intellectual Property Office on Oct. 28, 2013, the entire contents of which are incorporated herein by reference.

BACKGROUND (a) Field of the Invention

The present invention relates to a variable valve device that lifts valves for opening an intake port and an exhaust port that are connected to a combustion chamber, and varies the lift amount so as to improve efficiency depending on driving conditions of an engine.

(b) Description of the Related Art

Various methods for varying the movement of a valve in an internal combustion engine are well known.

Typically, a conventional method uses a camshaft, a rocker arm, or a finger follower to control the movement of the valve.

When a conventional variable valve device is used in an internal combustion engine, the object thereof is improving the fuel efficiency, and there is a known method that uses a profile of a cam to directly control the lift of the valve and there is a known method that uses lost motion to control the lift of the valve.

A hydraulic lash adjuster is used to reduce the gap between a valve and a swing arm on a variable valve train, and it is hard to simplify the variable valve device and the hydraulic lash adjuster.

PRIOR ART FIG. 5 is a cross-sectional view of a variable valve device. Referring to FIG. 5, the variable valve device includes a swing arm 150, a lost pin 155, a lost body 140, a roller 125, a guide pin 160, a latching pin 425, a latching spring 115, a latching cap 415, a valve 135, and a hydraulic pressure lash adjuster 120.

The latching pin 425 is inserted into the latching groove 405 that is formed at an opposite side of the lost pin 155 on the swing arm 150, and the latching spring 115 elastically presses the latching pin 425 toward the lost pin 155.

Meanwhile, the swing arm 150 rotates in a counterclockwise direction based on a support point of the hydraulic pressure lash adjuster 120 to repeatedly press the valve 135 in a lower diction and an inertial force of the latching pin 425 is formed in a left side by a high speed rotation movement of the swing arm 150, and therefore the control precision of the latching pin 425 can be deteriorated.

Further, in a case that two valves 135 are disposed and two hydraulic pressure lash adjusters 120 are disposed, a gap or a deviation is formed between the hydraulic pressure lash adjuster 120 and the swing arm 150 and the latching pin 425 can be abnormally operated by the leak of the oil.

The above information disclosed in this Background section is only for enhancement of understanding of the background of the invention and therefore it may contain information that does not form the prior art that is already known in this country to a person of ordinary skill in the art.

SUMMARY

The present invention provides a variable valve device for varying the lift amount of a valve having advantages that a hydraulic pressure lash adjuster securely supports a swing arm and accurately controls a latching pin that fixes a swing arm with a lost body.

As described above, a variable valve device for varying a lift amount of a valve according to an exemplary embodiment of the present invention includes a first valve and a second valve that is respectively disposed to open or close a port, a swing arm in which a first valve pressing portion and a second valve pressing portion are formed at both sides to press the first valve and the second valve, one supporting portion that supports a part that is apart from the first and the second valve pressing portion on the swing arm, a lost body that is rotatably disposed on the swing arm through a lost pin, a camshaft on which a first cam and a second cam are formed to respectively press the lost body and the swing arm, and a latching pin that selectively fixes the swing arm with the lost body and is disposed to move in a direction that the first and the second valves are arranged.

A center axis of a length direction of the lost pin may be disposed in a direction that the first and the second valves are arranged.

The variable valve device may include a roller that is disposed to correspond to the first cam on the lost body, and a guide pin that penetrates the swing arm, the lost body, and the roller to be parallel with the lost pin, wherein a guide groove is formed such that the guide pin moves on the swing arm together with the lost body and the roller, in a condition that the latching pin release the connection of the swing arm and the lost body.

The latching pin may be respectively disposed at both sides to correspond to the first valve and the second valve, and the latching pin is inserted into a latching groove that is formed at both side surfaces of the swing arm, and comprising an elastic member that is inserted into the latching groove to elastically support the latching pin, and a latching cap that closes the insertion groove and supports the elastic member.

The support portion may be a hydraulic pressure lash adjuster that uses hydraulic pressure to adjust a gap with the swing arm.

Hydraulic pressure may be supplied to the latching pin through the hydraulic pressure lash adjuster and the swing arm and the latching pin may connect or separate the swing arm and the lost body depending on the supply of the hydraulic pressure.

A seat groove that one end portion of the hydraulic pressure lash adjuster is seated may be formed.

The variable valve device may include a lost spring that is disposed at both sides of the swing arm and may elastically support the guide pin such that the roller that is disposed on the guide pin contacts the first cam.

A swing arm passage may be formed in the swing arm so as to transfer the hydraulic pressure from the hydraulic pressure lash adjuster to the latching pin, and the swing arm passage may be opened toward both sides of the swing arm, and may include a passage cap that closes the opened portion of the swing arm passage.

The second cam may be respectively formed at both sides of the first cam, and the lost body may be disposed to correspond to the first cam.

In accordance with the present invention, one hydraulic pressure lash adjuster is used for two valves such that a gap between a swing arm and a hydraulic pressure lash adjuster is eliminated, and a latching pin that fixes a swing arm with a lost body can be accurately controlled.

DETAILED DESCRIPTION OF THE EMBODIMENTS

An exemplary embodiment of the present invention will hereinafter be described in detail with reference to the accompanying drawings.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Further, the control logic of the present invention may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Figure 1:
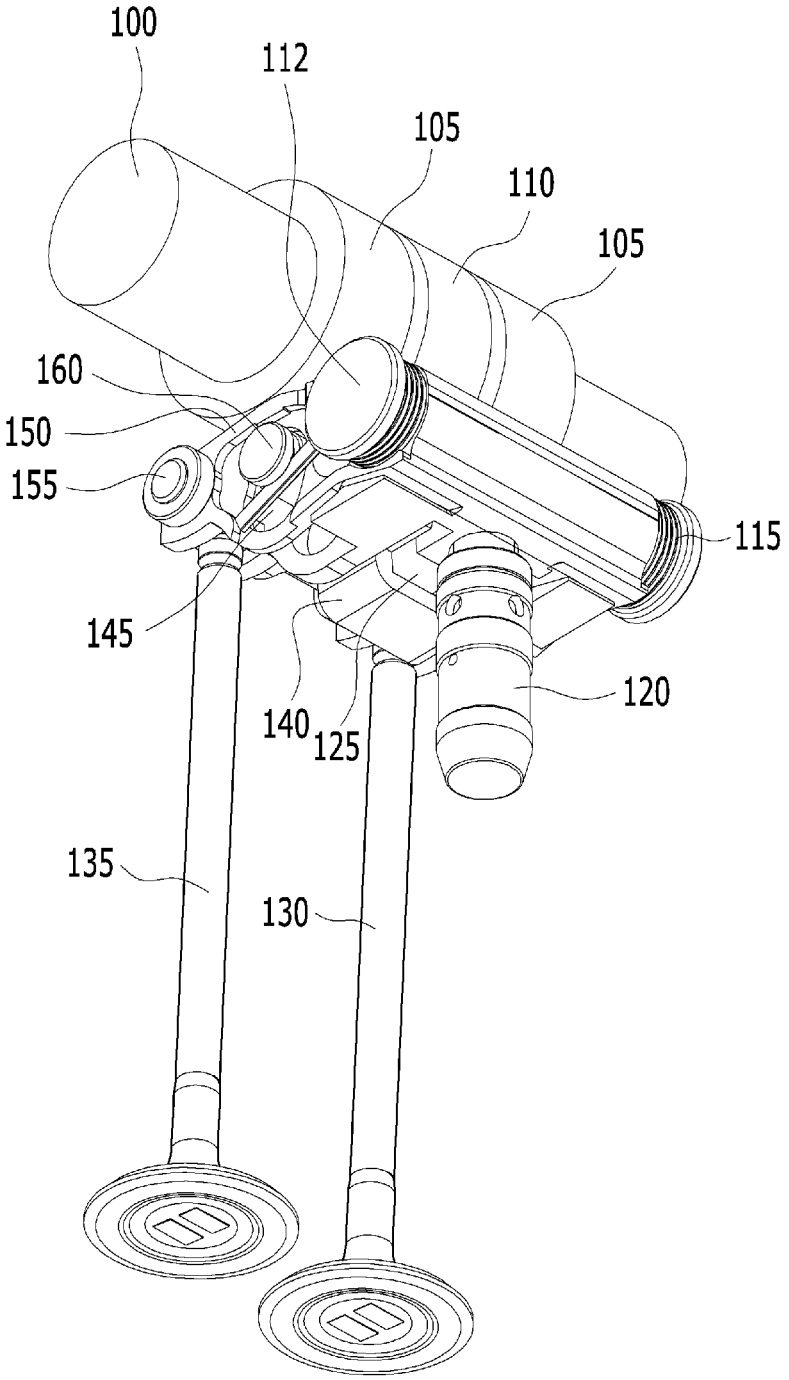
FIG. 1 is a perspective view of a variable valve device for varying a lift amount of a valve according to an exemplary embodiment of the present invention.

FIG. 1 is a perspective view of a variable valve device for varying a lift amount of a valve according to an exemplary embodiment of the present invention.

Referring to FIG. 1, a variable valve device includes a camshaft 100, a first cam 110, a second cam 105, a swing arm 150, a lost body 140, a roller 125, a lost pin 155, a guide pin 160, a passage cap 112, a lost spring 115, a hydraulic pressure lash adjuster 120, a first valve 135, and a second valve 130.

The second cam 105 is formed at both sides of the first cam 110, the lost body 140 is disposed to correspond to the first cam 110, and the swing arm 150 is disposed to correspond to the second cam 105.

In particular, the lost body 140 is formed at a central portion of a width direction of the swing arm 150. Further, the roller 125 is disposed at a position that corresponds to the first cam 110 on the lost body 140.

The first valve 135 and the second valve 130 support both sides of a lower one side of the swing arm 150, and the hydraulic pressure lash adjuster 120 supports one point of the other side of the swing arm 150.

The lost pin 155 is disposed to penetrate one side of the swing arm 150 and the lost body 140, and the first and the second valve 135 and 130 support both sides of the swing arm 150 corresponding to both sides of the lost pin 155.

A latching pin 425 (see FIG. 4) fixes or separates the swing arm 150 and the lost body 140. If the latching pin 425 separates the swing arm 150 and the lost body 140, the lost body 140 is rotated by the first cam 110 based on the lost pin 155 and the guide pin 160 moves along the guide groove 145 that is formed on the swing arm together with the lost body 140.

Further, the lost spring 115 that is disposed on the swing arm 150 elastically supports the guide pin 160 in an upper side such that the roller 125 of the lost body 140 contacts the first cam 110.

Figure 2:
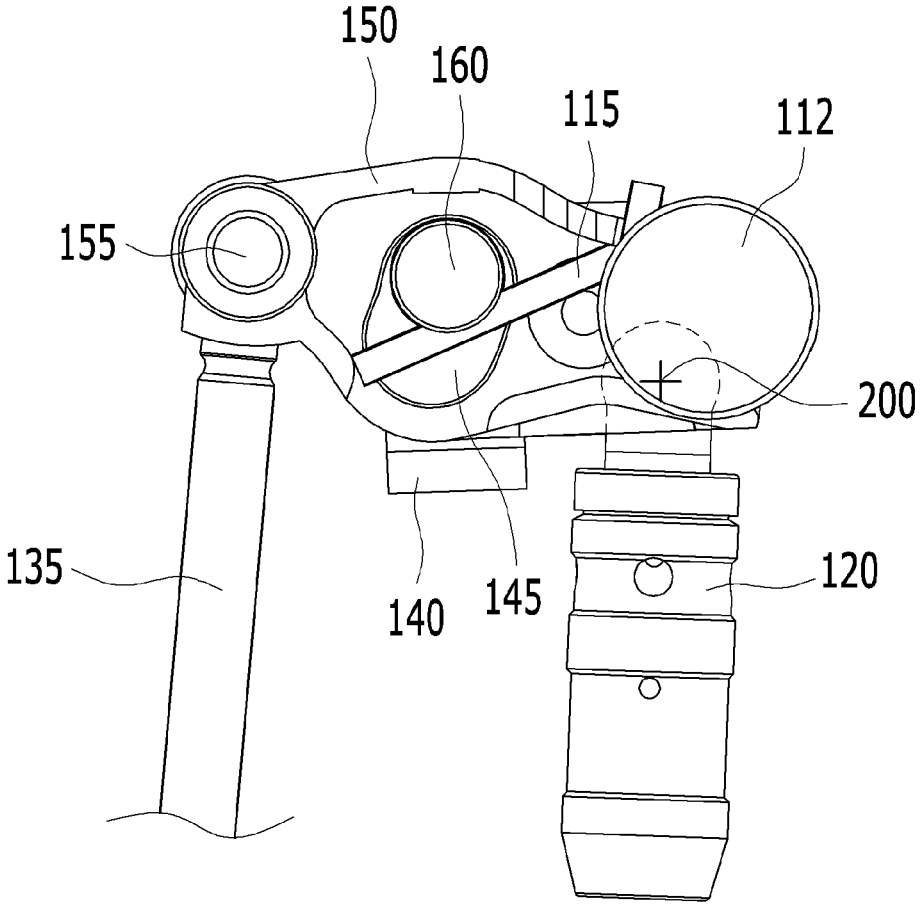
FIG. 2 is a side view of the variable valve device of FIG. 1.

FIG. 2 is a side view of a variable valve device for varying a lift amount of a valve according to an exemplary embodiment of the present invention.

Referring to FIG. 2, a swing arm rotation center point 200 is formed at a part that the hydraulic pressure lash adjuster 120 supports the swing arm 150 as one main supporter.

If the first and the second cam 110 and 105 press the swing arm 150 in a lower side thereof, the swing arm 150 rotates in a counterclockwise direction based on the swing arm rotation center point 200 to press the first and the second valves 135 and 130 in a lower side.

When the swing arm 150 and the lost body 140 are connected by the latching pin 425, the first cam 110 presses the roller 125 of the lost body 140, and the lost body 140 presses the swing arm 150 through the latching pin 425 in a high lift such that the first and the second valves 135 and 130 are opened in a lower side.

When the swing arm 150 and the lost body 140 are separated by the latching pin 425, the first cam 110 presses the roller 125 of the lost body 140, and the lost body 140 and the guide pin 160 rotates in a clockwise direction based on the lost pin 155 to perform a lost motion.

In this stage, the guide pin 160 moves along the guide groove 145, and the swing arm 150 presses the first and second valves 135 and 130 in a low lift through the second cam 105.

Figure 3:
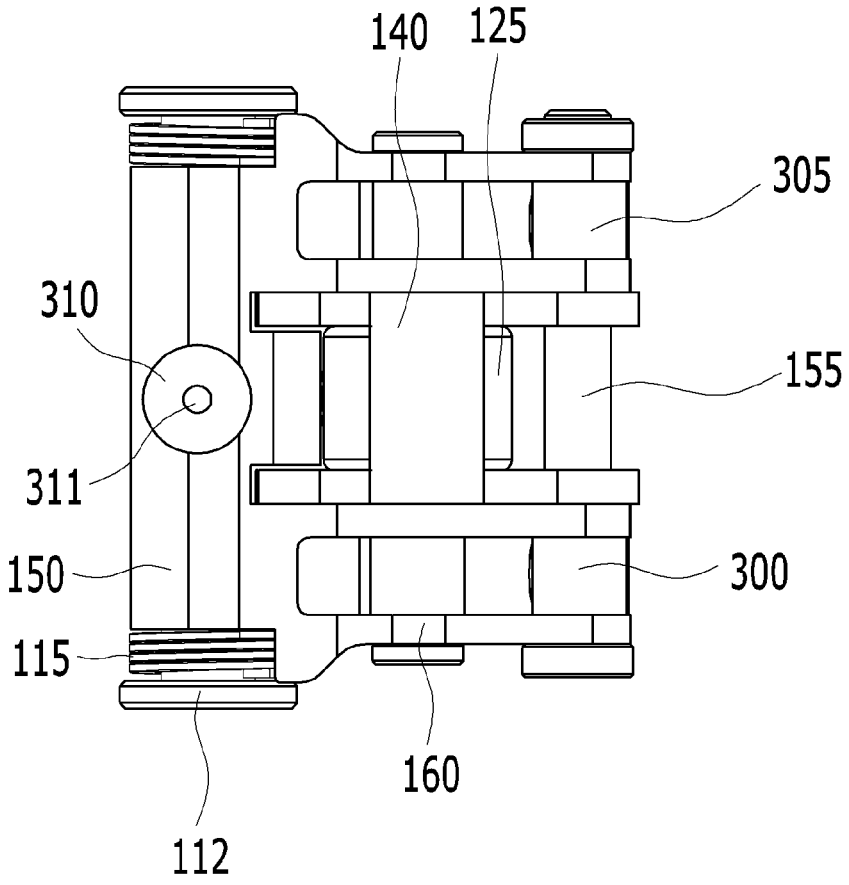
FIG. 3 is a bottom view of the variable valve device of FIG. 1.

FIG. 3 is a bottom view of a variable valve device for varying a lift amount of a valve according to an exemplary embodiment of the present invention.

Referring to FIG. 3, on a variable valve device, a seat groove 310 of a hemispherical shape is formed at a central portion of a width direction at the other side of a lower surface of the swing arm 150, and a passage inlet 315 is formed at an inner side of the seat groove 310. The hydraulic pressure that is supplied the hydraulic pressure lash adjuster 120 is selectively transmitted to the latching pin 425 through the passage inlet 315.

As shown in the drawings, the guide pin 160 and the lost pin 155 are disposed in parallel with each other in a width direction on the swing arm 150, and the first valve pressing portion 300 and the second valve pressing portion 305 are formed at both edge sides of one side of a lower surface of the swing arm 150 corresponding to the lost pin 155.

The first valve pressing portion 300 corresponds to the first valve 135 to press an upper end of the first valve 135 and the second valve pressing portion 305 corresponds to the second valve 130 to press an upper end of the second valve 130.

Figure 4:
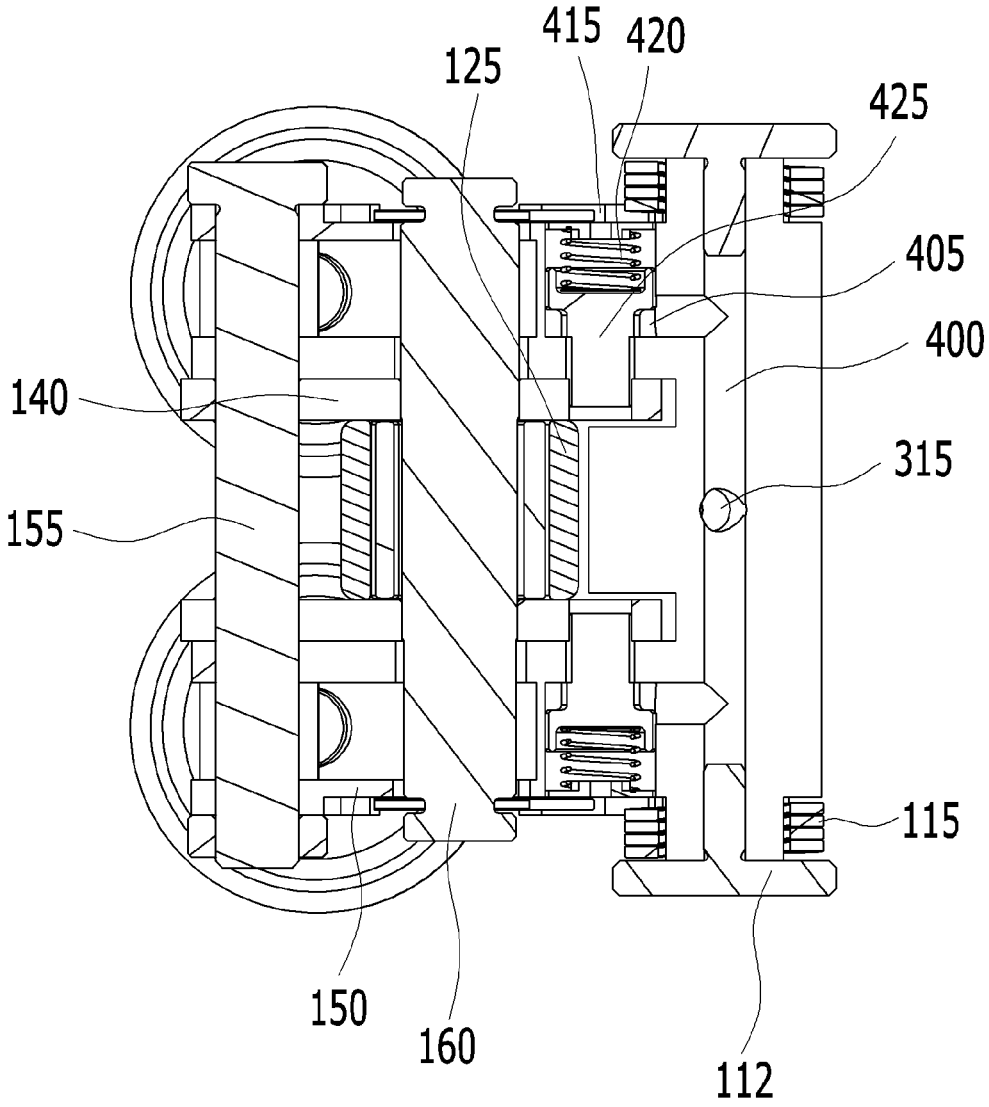
FIG. 4 is a sectional top plan view of the variable valve device of FIG. 1.
Figure 5:
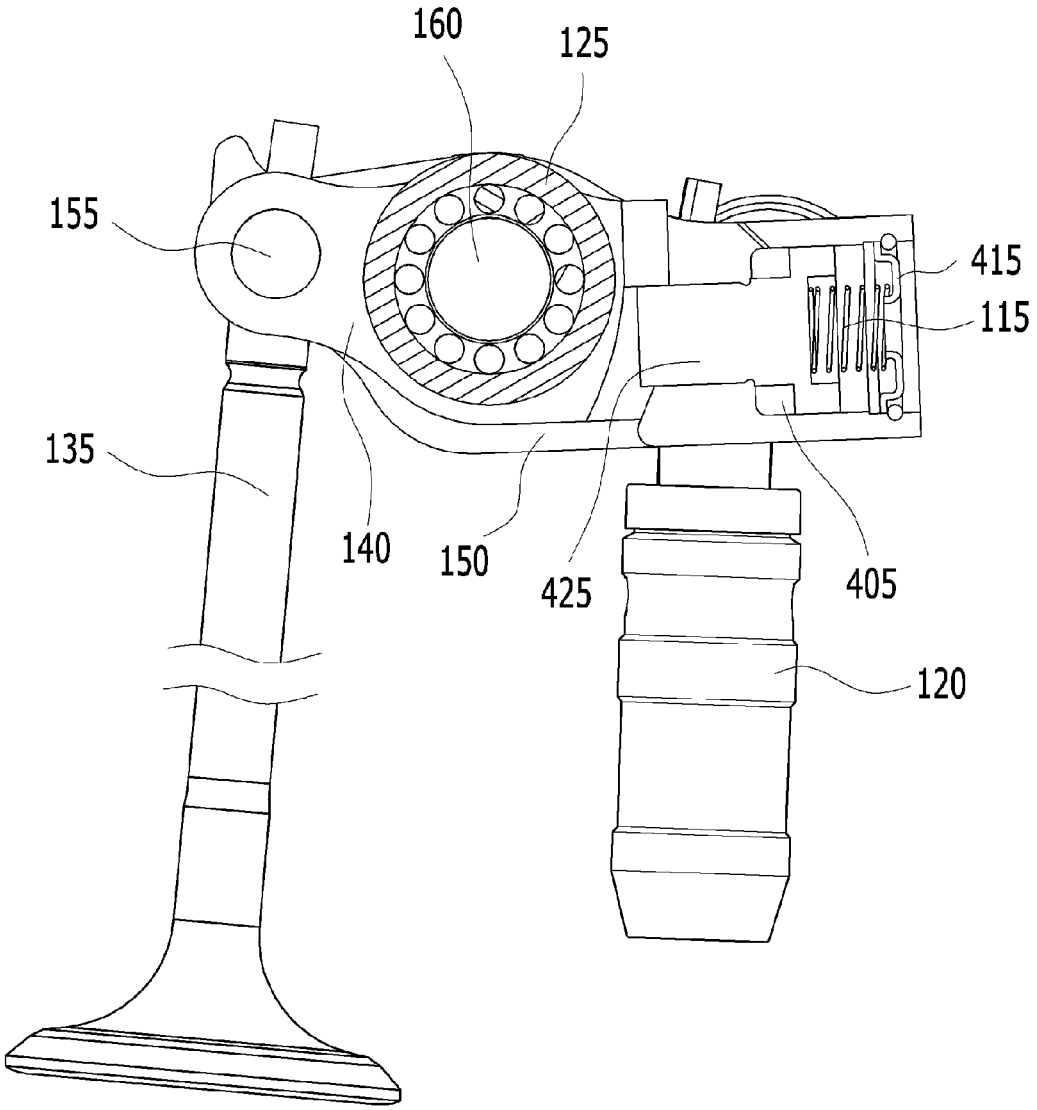
FIG. 5 (PRIOR ART)
FIG. 5 (PRIOR ART) is a cross-sectional view of a conventional variable valve device.

FIG. 4 is a sectional top plan view of a variable valve device for varying a lift amount of a valve according to an exemplary embodiment of the present invention.

Referring to FIG. 4, a swing arm passage 400 is formed inside the swing arm 150 at an opposite side of the lost pin 155 in a width direction and the swing arm passage 400 is opened in both sides. The swing arm passage that the both sides thereof are opened is closed by a passage cap 112. The swing arm passage 400 receives hydraulic pressure through the hydraulic pressure lash adjuster 120 and the passage inlet 315.

A latching groove 405 is respectively formed at both sides of a width direction inside the swing arm 150 between the swing arm passage 400 and the guide pin 160, and the latching pin 425 and a latching spring 420 are sequentially inserted into the latching groove 405. And, the latching groove 405 is closed by a latching cap 415.

If hydraulic pressure is not supplied through the swing arm passage 400, the latching spring 420 is supported by the latching cap 415, the latching pin 425 is elastically pushed toward an inner side, and the latching pin 425 latches the swing arm 150 and the lost body 140 with each other through the latching spring 420.

Accordingly, if the first cam 110 presses the lost body 140, the lost body 140 and the swing arm 150 move together through the latching pin 425 such that the first and the second valves 135 and 130 is moved in a high lift.

In contrast, if hydraulic pressure is supplied through the swing arm passage 400, the latching pin 425 compresses the latching spring 420 and moves in an outside direction, and the latching pin 425 separates the swing arm 150 and the lost body 140.

Accordingly, if the first cam 110 presses the lost body 140, the lost body 140 performs a lost motion based on the lost pin 155, and the swing arm 150 moves the first and the second valves 135 and 130 in a low lift through the second cam 105 or the first and the second valves 135 and 130 are not lifted.

In an exemplary embodiment of the present invention, if the latching pin 425 separates the lost body 140 and the swing arm 150, the first and the second valves 135 and 130 cannot be opened or be operated in a low lift. If the first and the second valves 135 and 130 are not opened, the cylinder corresponding to this can be deactivated.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A variable valve device for varying a lift amount of a valve, comprising:

a first valve and a second valve that are respectively disposed to open or close a port;

a swing arm in which a first valve pressing portion and a second valve pressing portion are formed at both sides to press the first valve and the second valve;

one supporting portion that supports a part that is apart from the first and the second valve pressing portion on the swing arm;

a lost body that is rotatably disposed on the swing arm through a lost pin;

a camshaft on which a first cam and a second cam are formed to respectively press the lost body and the swing arm;

a latching pin that selectively fixes the swing arm with the lost body and is disposed to move in a direction that the first and the second valves are arranged;

a roller that is disposed to correspond to the first cam on the lost body; and a guide pin that penetrates the swing arm, the lost body, and the roller to be parallel with the lost pin, wherein a guide groove is formed such that the guide pin moves on the swing arm together with the lost body and the roller, in a condition that the latching pin releases the connection of the swing arm and the lost body.

2. The variable valve device of claim 1, wherein a center axis of a length direction of the lost pin is disposed in a direction that the first and the second valves are arranged.

3. The variable valve device of claim 1, wherein the latching pin is respectively disposed at both sides to correspond to the first valve and the second valve.

4. The variable valve device of claim 1, wherein:

the latching pin is inserted into a latching groove that is formed at both side surfaces of the swing arm, and comprising an elastic member that is inserted into the latching groove to elastically support the latching pin; and a latching cap that closes the insertion groove and supports the elastic member.

5. The variable valve device of claim 1, wherein the support portion is a hydraulic pressure lash adjuster that uses hydraulic pressure to adjust a gap with the swing arm.

6. The variable valve device of claim 5, wherein hydraulic pressure is supplied to the latching pin through the hydraulic pressure lash adjuster and the swing arm and the latching pin connects or separates the swing arm and the lost body depending on the supply of the hydraulic pressure.

7. The variable valve device of claim 5, wherein a seat groove that one end portion of the hydraulic pressure lash adjuster is seated is formed.

8. The variable valve device of claim 1, further comprising a lost spring that is disposed at both sides of the swing arm and elastically supports the guide pin such that the roller that is disposed on the guide pin contacts the first cam.

9. The variable valve device of claim 5, wherein a swing arm passage is formed in the swing arm so as to transfer the hydraulic pressure from the hydraulic pressure lash adjuster to the latching pin, the swing arm passage is opened toward both sides of the swing arm, and further comprising a passage cap that closes the opened portion of the swing arm passage.

10. The variable valve device of claim 1, wherein the second cam is respectively formed at both sides of the first cam, and the lost body is disposed to correspond to the first cam.

* * * * *